US006473904B2

(12) United States Patent
Long

(10) Patent No.: US 6,473,904 B2
(45) Date of Patent: Nov. 5, 2002

(54) SCUBA DIVING WETSUIT

(76) Inventor: Carole D. Long, 1297 Central Avenue, Thunder Bay, Ontario (CA), P7B 6C2

( * ) Notice: Subject to any disclaimer, the term of this patent is extended or adjusted under 35 U.S.C. 154(b) by 0 days.

(21) Appl. No.: 09/962,620

(22) Filed: Sep. 26, 2001

(65) Prior Publication Data

US 2002/0040495 A1 Apr. 11, 2002

Related U.S. Application Data

(60) Provisional application No. 60/236,793, filed on Sep. 27, 2000.

(51) Int. Cl.[7] ..... B63C 11/04
(52) U.S. Cl. ..... 2/2.15; 2/2.17; 2/126
(58) Field of Search ..... 2/2.15, 2.17, 126

(56) References Cited

U.S. PATENT DOCUMENTS 2,749,551 A * 6/1956 Gabellaro ..... 2/2.15
4,638,509 A 1/1987 Charron
4,649,656 A 3/1987 Cox et al.
4,862,517 A 9/1989 Meistrell
4,907,295 A 3/1990 Yasuda
5,088,116 A * 2/1992 Gould ..... 2/115
5,222,313 A 6/1993 Dowdy et al.
5,628,064 A * 5/1997 Chung ..... 2/119
5,826,274 A 10/1998 Thompson

* cited by examiner

*Primary Examiner*—A Vanatta
*Assistant Examiner*—Robert Muromoto
(74) *Attorney, Agent, or Firm*—Ryan W. Dupuis; Adrian D. Battison; Michael R. Williams

(57) ABSTRACT

A wetsuit is provided having a torso portion arranged to be secured about a torso of a person. The torso portion includes a neck opening, a pair of upper limb openings and a pair of lower limb openings. A limb extension can be attached to each of the limb openings for covering a respective limb of the person. Each limb extension comprises an elongate tubular member extending longitudinally between an inner end arranged to be secured to the torso portion and an outer free end. The limb extensions can thus be added and removed as desired such that a single wetsuit can be modified for use in varying dive conditions. The use of a single adjustable suit is considerably less costly as compared to purchasing several different types of suits while being convenient enough to adjust to different dive conditions without the need to even remove the torso portion of the suit.

20 Claims, 2 Drawing Sheets

SCUBA DIVING WETSUIT

This application claims the benefit of provisional application No. 60/236,793, filed Sep. 27, 2002.

FIELD OF THE INVENTION

This invention relates to a scuba diving wetsuit and more particularly to a wetsuit which is adjustable for use in different diving conditions.

BACKGROUND

The use of a wetsuit is known by divers for insulating the divers from cold water when submerged and for protecting divers from injury from marine life including jellyfish and the like or from abrasions when diving in rough terrain such as caves. Depending upon the expected water temperature and level of protection required, divers wear different styles of wetsuits which may or may not include limbs integrally formed within the suit. A full suit having full arm and leg coverings provides added insulation and protection but is more obstructive and uncomfortable in comparison to a short suit without full arms or leg coverings. The short suit is thus desirable when warmer water and less harsh conditions permits as it is considerably more comfortable.

To make use of the advantages of both full and short wetsuits, divers must purchase a separate suit as well as varying intermediate styles of suits depending upon each diving condition they expect to encounter. Diving conditions, including temperature, marine life and terrain to be encountered, can vary significantly with depth or time of day of a dive such that a diver may require different wetsuits even if diving in the same area throughout a given day. When the diver frequents numerous diving conditions, the abundance of suits required is costly and requires considerable maintenance to store and keep the suits in good condition.

SUMMARY

According to one aspect of the present invention there is provided a wetsuit comprising;

a torso portion arranged to be secured about a torso of a person, the torso portion having a neck opening arranged to receive a neck of the person therethrough, a pair of upper limb openings arranged to receive respective upper limbs of the person therethrough and a pair of lower limb openings arranged to receive respective lower limbs of the person therethrough; and a pair of limb extensions associated with the respective limb openings of at least one pair of limb openings, each limb extension comprising an elongate tubular member extending longitudinally from an inner end to an outer end so as to receive a corresponding limb of the person therethrough;

the inner end of each limb extension being arranged to be secured to the torso portion.

The wetsuit of the present invention provides limb extensions that can be added and removed as desired such that a single wetsuit can be modified for use in varying dive conditions. The use of a single adjustable suit is considerably less costly as compared to purchasing several different types of suits while being convenient enough to adjust to different dive conditions without the need to even remove the body portion of the suit. This is particularly useful when a diver wishes to accommodate the different temperatures, marine life and terrain to be encountered resulting from a different time of day of dive or a different depth of dive during a given dive expedition.

The inner end of each limb extension may be arranged to be secured to the torso portion in an overlapping configuration.

The torso portion preferably includes a pair of partial limb members coupled to the respective limb openings of at least one of the pairs of limb openings, the partial limb members being arranged to extend only partway along the respective limbs of the person to respective free ends of the partial limb members, each pair of partial limb members including a pair of limb extensions arranged to be coupled thereto.

The partial limb members may be coupled to the upper limb openings of the torso portion with the limb extensions being arranged to extend over the respective arms of the person.

Alternatively, the partial limb members are coupled to the lower limb openings of the torso portion with the limb extensions being arranged to extend over the respective legs of the person.

It is preferred however that the partial limb members be coupled to both the upper and lower limb openings of the torso portion with the limb extensions being arranged to extend over the respective arms and legs of the person.

An outer diameter of the inner end of each limb extension is preferably reduced in diameter such that the torso portion is arranged to overlap the inner end of the limb extension.

There may be provided a shoulder about an outer periphery of each limb extension between a main portion of the limb extension and the inner end of the limb extension which is reduced in thickness.

When the partial limb members are associated with the arms of the person, the partial limb members are preferably arranged to extend only partway along respective upper arms of the person such that the free end of each partial limb member terminates between a shoulder and an elbow of the person when in use.

When the partial limb members are associated with the legs of the person, the partial limb members are preferably arranged to extend only partway along respective upper legs of the person such that the free end of each partial limb member terminates between a hip and a knee of the person when in use.

There may be provided a first mating surface on the inner end of each limb extension and a second mating surface on the free end of each partial limb member, the first mating surfaces being arranged to mate with the respective second mating surfaces in the overlapping configuration.

The first and second mating surfaces are preferably textured.

There may be provided a first connector on the inner end of each limb extension and a second connector on the torso portion associated with each limb extension, the first connectors being arranged to be coupled to the respective second connectors for securing the limb extensions to the torso portion.

In, a further mounting arrangement, the limb extensions may include respective longitudinally extending expansion slots at respective inner ends thereof and respective couplings arranged to selectively constrict the respective expansion slots about the respective partial limb members in an overlapping configuration. The couplings preferably each comprise a longitudinally extending zipper.

In an alternate mounting configuration, the expansion slot and zipper may be located on the respective partial limb members instead of on the limb extension members.

BRIEF DESCRIPTION OF THE DRAWINGS

In the accompanying drawings, which illustrate exemplary embodiments of the present invention.

DETAILED DESCRIPTION

Figure 1:
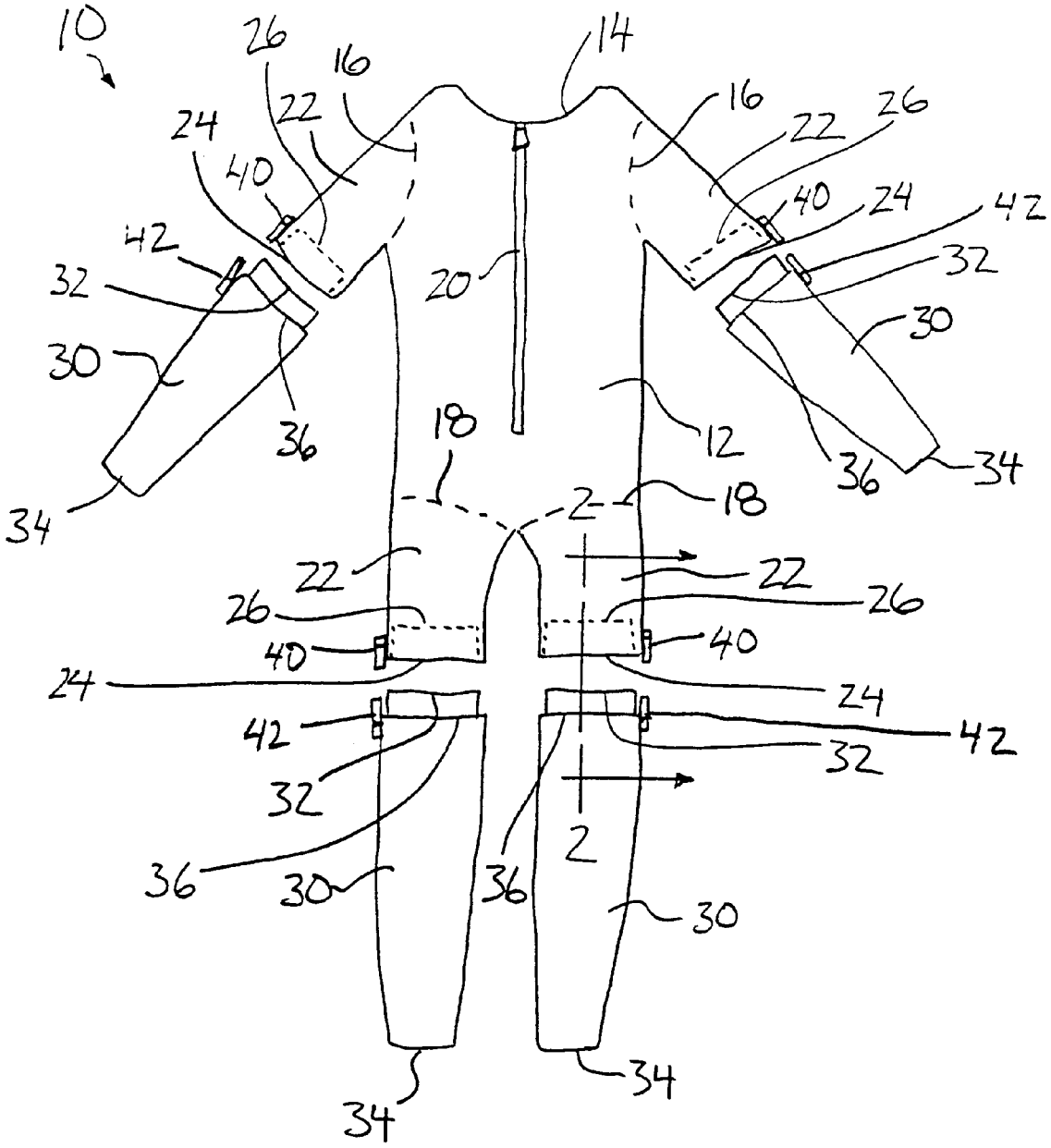
FIG. 1 is a front elevational view of the wetsuit shown with the limb extensions detached therefrom.
Figure 2:
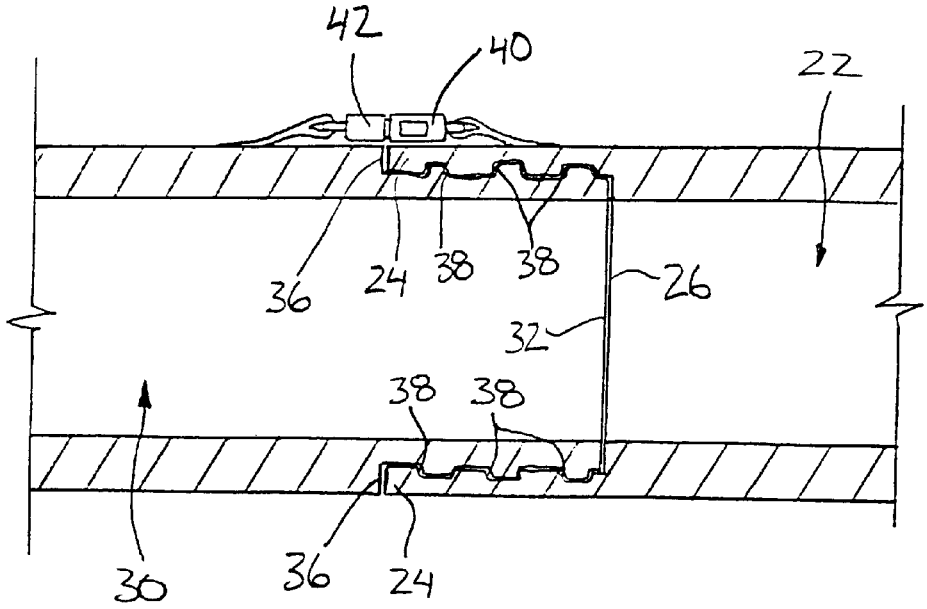
FIG. 2 is a sectional view generally taken along the line 2—2 of FIG. 1 with the limb extensions shown attached to the body portion in an overlapping configuration.

Referring initially to FIGS. 1 and 2, there is illustrated a wetsuit generally indicated by reference numeral 10. The wetsuit 10 is adjustable for use in varying dive conditions for improved comfort regardless of water temperature, marine life to be encountered or terrain using only a single wetsuit.

The wetsuit 10 includes a torso portion 12 which is similar to conventional wetsuits having a neck opening 14 for receiving the neck and head of a person therethrough when the torso portion 12 is worn about a torso of the diver. The torso portion 12 further includes a pair of upper limb openings 16 arranged to receive respective arms of the diver there through and a pair of lower limb openings 18 arranged to receive respective legs of the diver therethrough when the torso portion is worn by the diver.

The torso portion 12 is fitted to the diver and formed of a neoprene type material as in conventional wetsuits. A zipper 20 is further included also as in conventional wetsuits for permitting the diver to enter and exit the wetsuit.

A partial limb member 22 is attached to each of the limb openings 16 and 18 so as to form a continuous suit with the torso portion 12. Each partial limb member 22 is a tube member extending only partway along the respective arm or leg of the diver so as to terminate at a free end 24 spaced from the respective limb opening. The partial limb members 22 associated with the upper limb openings 16 are arranged to terminate partway along the upper arm of the diver such that the free end 24 thereof terminates between a respective shoulder and elbow of the diver when the wetsuit 10 is worn. The partial limb members 22 associated with the lower limb openings 18 are arranged to extend along the respective legs of the diver to terminate partway along the thigh of the diver such that the free end 24 terminates between a respective hip and knee of the diver.

The free end 24 of each partial limb member 22 has a reduced thickness which defines a portion of increased inner diameter terminating at a shoulder 26 located about an inner circumference of each partial limb member 22 spaced inwardly from the free end 24 thereof.

A limb extension 30 is arranged to be coupled to each partial limb member 22 for extending over a respective arm or leg of the diver. Each limb extension 30 comprises a tube member of similar material as the torso portion of the wetsuit which is fitted to extend substantially the full length of a respective arm or leg of the diver. Each limb extension 30 extends from an inner end 32 arranged to be coupled to the free end 24 of the partial limb member 22 associated therewith to an outer end 34 of the limb extension.

The inner end 32 of each limb extension 30 is reduced in thickness so as to define a portion of reduced outer diameter which terminates at a shoulder 36 about an outer periphery of the limb extension 30 at a location spaced from the inner end 32. The length of the portion of reduced thickness of the inner end of each limb extension is approximately equal to the length of the portion of reduced thickness at the free end 24 of each partial limb member 22 such that in an overlapped configuration as illustrated in FIG. 2, the shoulder 26 engages the inner end 32 while the shoulder 36 engages the free end 24.

A first mating surface is defined about an inner surface of the free end 24 of each partial limb member while a second mating surface is defined about an outer surface of the inner end of each limb extension such that the first and second mating surfaces mat with each other on the overlapped configuration of FIG. 2.

Each of the first and second mating surfaces include a plurality of alternating annular ribs 38 such that the ribs provide an interlocking textured surface to the first and second mating surfaces for assisting in gripping between the partial limb members 22 and the respective limb extensions 30.

In the overlap configuration of FIG. 2 the combined thickness of the free ends 24 of the partial limb members 22 and the associated inner end 32 of the limb extension 30 is approximately equal to the normal thickness of the torso portion 12 and the remainder of the limb extensions 30.

A first connector 40 is mounted on each partial limb member 22 adjacent the free end thereof. A second connector 42 is mounted on each limb extension 30 adjacent the inner end 32 thereof. The first and second connectors are thus arranged to be coupled together when the limb extensions 30 are in an overlapped condition with the partial limb members 22. The first and second connectors 40 and 42 comprise respective male and female ends of a conventional snap connector which is arranged to be selectively separable for disconnection and removal of the limb extension 30 as desired.

In use a diver first puts on the torso portion 12 of the wetsuit using the zipper 20 as in a conventional wetsuit. If the diving conditions indicate that it is preferable to include arm and leg coverings, the diver rolls up the free ends 24 of each partial limb member 22 so as to receive a respective limb extension 30 thereunder. The diver then slides on the desired limb extensions 30 over the respective arms and legs of the diver so as to be aligned with the respective partial limb members 22 when unrolled. The diver then unrolls the free ends 24 of the respective partial limb members 22 such that the free ends 24 overlap the inner ends 32 of the respective limb extensions as shown in FIG. 2. Connecting the first and second connectors further secures the limb extensions to the torso portion of the wetsuit.

Depending upon the expected depth of dive, temperature of the water, marine life or terrain to be encountered, the diver may choose to use the wetsuit 10 without any limb extensions 30 or the diver may alternatively choose to secure limb extensions 30 over respective arms, legs, or both arms and legs. The wetsuit 10 thus provides four considerably different wetsuit arrangements in a single wetsuit depending upon the addition and removal of respective arm or leg limb extensions 30.

In further embodiments the mating surfaces in the overlapped configuration may be provided with an alternate texture or material which provides sufficient grip without texture. Furthermore the reduced thickness at the free end 24 of the partial limb members 22 or the inner ends 32 of the limb extensions 30 may be substituted by varying the diameter in place of changing the thickness of the material.

In further embodiments the first and second connectors 40 and 42 may be replaced with numerous types of conventional connectors as well as multiple connectors which are circumferencially spaced about the respective limb extensions 30. A connector such as a zipper may also be appropriate.

Figure 3:
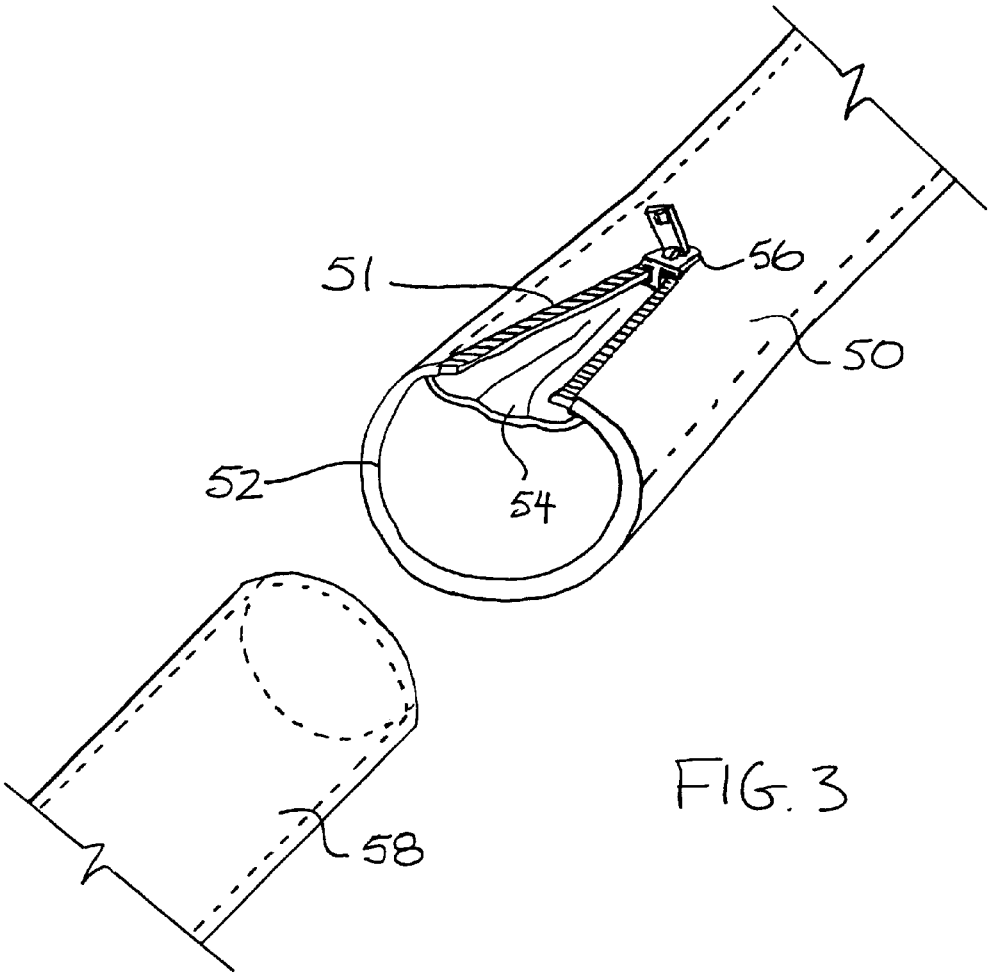
FIG. 3 is an isometric view of an alternate mounting arrangement for the limb extensions.

Referring to FIG. 3 there is illustrated an alternate mounting arrangement for mounting the limb extensions to the respective partial limb members. Each partial limb member 50 includes a longitudinal expansion slot 51 extending inwardly from an outer end 52 thereof. A foldable flap of material 54 spans the slot so as to define a flared portion at the end of the partial limb member 50. A longitudinally extending zipper 56 is provided for selectively constricting the flared portion at the end of the partial limb member 50.

The flared portion permits a corresponding limb extension 58 to be received therein before the partial limb member is constricted using the zipper 56. The limb extension is thus securely connected to the respective partial limb member in an overlapping configuration.

In further variations of the arrangement of FIG. 3, the overlapping surfaces may also be textured as described in the previous embodiment. Also, the flared portion including the expansion slot 51 and the zipper 56 may be formed on the limb extension such that the limb extension is arranged to overlap the partial limb member instead of being overlapped the partial limb member as described above.

While various embodiments of the present invention have been described in the foregoing, it is to be understood that other embodiments are possible within the scope of the invention. The invention is to be considered limited solely by the scope of the appended claims.

What is claimed is:

1. A wetsuit comprising:

a torso portion arranged to be secured about a torso of a person, the torso portion having a neck opening arranged to receive a neck of the person therethrough, a pair of upper limb openings arranged to receive respective upper limbs of the person therethrough and a pair of lower limb openings arranged to receive respective lower limbs of the person therethrough;

a pair of partial limb members coupled to the respective limb openings of at least one of the pairs of limb openings, the partial limb members being arranged to extend only partway along the respective limbs of the person to respective free mating ends of the partial limb members; and a limb extension member associated with each partial limb member, each limb extension member comprising an elongate tubular member extending longitudinally from an inner mating end to an outer end so as to receive a corresponding limb of the person therethrough, the inner mating end of the limb extension member and the free mating end of the respective partial limb member being arranged to overlap one another in a mating configuration;

one of the limb extension member and the partial limb member of each mating configuration including a shoulder thereabout defined between a main portion of the member and the mating end of the member which is increased in internal diameter for overlapping the other mating end;

one of the free mating end and the inner mating end of each mating configuration being reduced in thickness.

2. The wetsuit according to claim 1 wherein the partial limb members are coupled to the upper limb openings of the torso portion and the limb extension members are arranged to extend over the respective arms of the person.

3. The wetsuit according to claim 1 wherein the partial limb members are coupled to the lower limb openings of the torso portion and the limb extension members are arranged to extend over the respective legs of the person.

4. The wetsuit according to claim 1 wherein the partial limb members are coupled to both the upper and lower limb openings of the torso portion and the limb extension members are arranged to extend over the respective arms and legs of the person.

5. The wetsuit according to claim 1 wherein an outer diameter of the inner mating end of each limb extension member is reduced in diameter such that the respective partial limb member is arranged to overlap the inner mating end of the limb extension number.

6. The wetsuit according to claim 5 wherein there is provided a shoulder about an outer periphery of each limb extension member between a main portion of the limb extension member and the inner mating end of the limb extension member which is reduced in thickness.

7. The wetsuit according to claim 2 wherein the partial limb members are arranged to extend only partway along respective upper arms of the person such that the free mating end of each partial limb member terminates between a shoulder and an elbow of the person when in use.

8. The wetsuit according to claim 3 wherein the partial limb members are arranged to extend only partway along respective upper legs of the person such that the free mating end of each partial limb member terminates between a hip and a knee of the person when in use.

9. The wetsuit according to claim 1 wherein there is provided a first mating surface on the inner mating end of each limb extension member and a second mating surface on the free mating end of each partial limb member, the first mating surfaces being arranged to mate with the respective second mating surfaces in the overlapping configuration.

10. A wetsuit comprising;

a torso portion arranged to be secured about a torso of a person, the torso portion having a neck opening arranged to receive a neck of the person therethrough, a pair of upper limb openings arranged to receive respective upper limbs of the person therethrough and a pair of lower limb openings arranged to receive respective lower limbs of the person therethrough;

a pair of partial limb members coupled to the respective limb openings of at least one of the pairs of limb openings, the partial limb members being arranged to extend only partway along the respective limbs of the person to respective free mating ends of the partial limb members including respective first mating surfaces; and a limb extension member associated with each partial limb member, each limb extension member comprising an elongate tubular member extending longitudinally from an inner mating end including a second mating surface to an outer end so as to receive a corresponding limb of the person therethrough;

wherein the first and second mating surfaces of the respective partial limb members and limb extension members are textured and arranged to mate respectively with one another in an overlapping configuration.

11. The wetsuit according to claim 1 wherein there is provided a first connector on the inner end of each limb extension member and a second connector on the torso portion associated with each limb extension member, the first connectors being arranged to be coupled to the respective second connectors for securing the limb members to the torso portion.

12. The wetsuit according to claim 1 wherein the limb extension members include respective longitudinally extending expansion slots at the respective inner mating ends thereof and respective couplings arranged to selectively constrict the respective expansion slots about the respective partial limb members in the mating configuration.

13. The wetsuit according to claim 12 wherein the couplings each comprise a longitudinally extending zipper for constricting the expansion slots.

14. The wetsuit according to claim 1 wherein the partial limb members include respective longitudinally extending expansion slots at the respective free mating ends thereof and respective couplings arranged to selectively constrict the respective expansion slots about the respective limb extensions in the mating configuration.

15. The wetsuit according to claim 14 wherein the couplings each comprise a longitudinally extending zipper for constricting the expansion slots.

16. The wetsuit according to claim 1 wherein both mating ends of each mating configuration are reduced in thickness in relation to a remaining portion of the respective member.

17. The wetsuit according to claim 1 wherein thickness at the mating configuration is substantially identical to thickness of both members of the mating configuration.

18. The wetsuit according to claim 1 wherein the inner mating end of each limb extension member is reduced in thickness.

19. A wetsuit comprising;

a torso portion arranged to be secured about a torso of a person, the torso portion having a neck opening arranged to receive a neck of the person therethrough, a pair of upper limb openings arranged to receive respective upper limbs of the person therethrough and a pair of lower limb openings arranged to receive respective lower limbs of the person therethrough;

a pair of partial limb members coupled to the respective limb openings of at least one of the pairs of limb openings, the partial limb members being arranged to extend only partway along the respective limbs of the person to respective free mating ends of the partial limb members including respective first mating surfaces;

a limb extension member associated with each partial limb member, each limb extension member comprising an elongate tubular member extending longitudinally from an inner mating end including a second mating surface to an outer end so as to receive a corresponding limb of the person therethrough, the inner mating end of the limb extension member and the free mating end of the respective partial limb member being arranged to overlap one another in a mating configuration;

one of the limb extension member and the partial limb member of each mating configuration including a longitudinally extending expansion slot at a respective mating end thereof for overlapping the mating end of the other member and couplings arranged to selectively constrict the respective expansion slot about said other member in the mating configuration.

20. The wetsuit according to claim 19 wherein the couplings each comprise a longitudinally extending zipper.

* * * * *